US005519367A

United States Patent [19]

Castonguay et al.

[11] Patent Number: 5,519,367

[45] Date of Patent: May 21, 1996

[54] CIRCUIT BREAKER LOGIC SWITCH SYSTEM

[75] Inventors: Roger N. Castonguay, Terryville; Jeffrey D. Lord, Unionville, both of Conn.

[73] Assignee: General Electric Company, New York, N.Y.

[21] Appl. No.: 324,044

[22] Filed: Oct. 18, 1994

[51] Int. Cl.[6] ..... H01H 75/00

[52] U.S. Cl. ..... 335/14; 335/20; 340/628

[58] Field of Search ..... 335/172–6, 167, 335/17, 14, 20, 23, 35; 340/638

[56] References Cited

U.S. PATENT DOCUMENTS

| | | | |
|---|---|---|---|
| 3,073,936 | 1/1963 | Baird et al. . | |
| 3,720,891 | 3/1973 | Nicol | 335/17 |
| 4,001,742 | 1/1977 | Jencks et al. . | |

*Primary Examiner*—Lincoln Donovan
*Attorney, Agent, or Firm*—Richard A. Menelly

[57] ABSTRACT

A logic switch take-up system is incorporated into a circuit breaker's electronic trip unit and signals the circuit breaker's programmer box that the electronic trip unit has been actuated and therefore that the circuit breaker contacts have been displaced from their closed to their open position.

3 Claims, 3 Drawing Sheets

CIRCUIT BREAKER LOGIC SWITCH SYSTEM

BACKGROUND OF THE INVENTION

The present invention relates to industrial circuit breakers and particularly to an assembly for signaling a circuit breaker's programmer box that the circuit breaker's electronic trip unit has been actuated, and therefore the circuit breaker contacts have been displaced from their closed to their open position.

High ampere-rated circuit breakers such as described in U.S. Pat. No. 3,073,936 entitled Electric Circuit Interrupter" are currently used in industrial facilities to protect humans and equipment from danger due to overcurrent conditions within the electrical distribution systems in those facilities. Many of these circuit breakers are controlled by electronic programmer boxes.

The programmer box is connected to a sensor that measures the current flow through the circuit breaker. When an overcurrent condition in the circuit breaker is detected by the programmer box, the programmer box actuates the circuit breaker's electronic trip unit which displaces the circuit breaker's contacts from their closed to their open position. As a result the current flow through the circuit breaker, and part or all of the electrical distribution system, is terminated.

To ensure the operability of the electronic trip unit, and thus the operability of the circuit breaker and user safety, it is desirable for the programmer box to confirm that the electronic trip unit has been actuated. Furthermore it is desirable to retrofit, with minimal adjustments, a means for detecting actuation of the electronic trip units into existing circuit breakers.

It is accordingly an object of the present invention to provide a logic switch take-up system that signals the programmer box when the electronic trip unit has been actuated.

A further object is to allow the logic switch take-up system to be installed into a circuit breaker's electronic trip unit with minimal adjustments.

SUMMARY OF THE INVENTION

In accordance with the present invention, there is provided a logic switch take-up system, incorporated into the circuit breaker's electronic trip unit, that signals the programmer box when the electronic trip unit has been actuated. The system includes a switch actuator and a switch.

DESCRIPTION OF THE PREFERRED EMBODIMENTS

Figure 1:
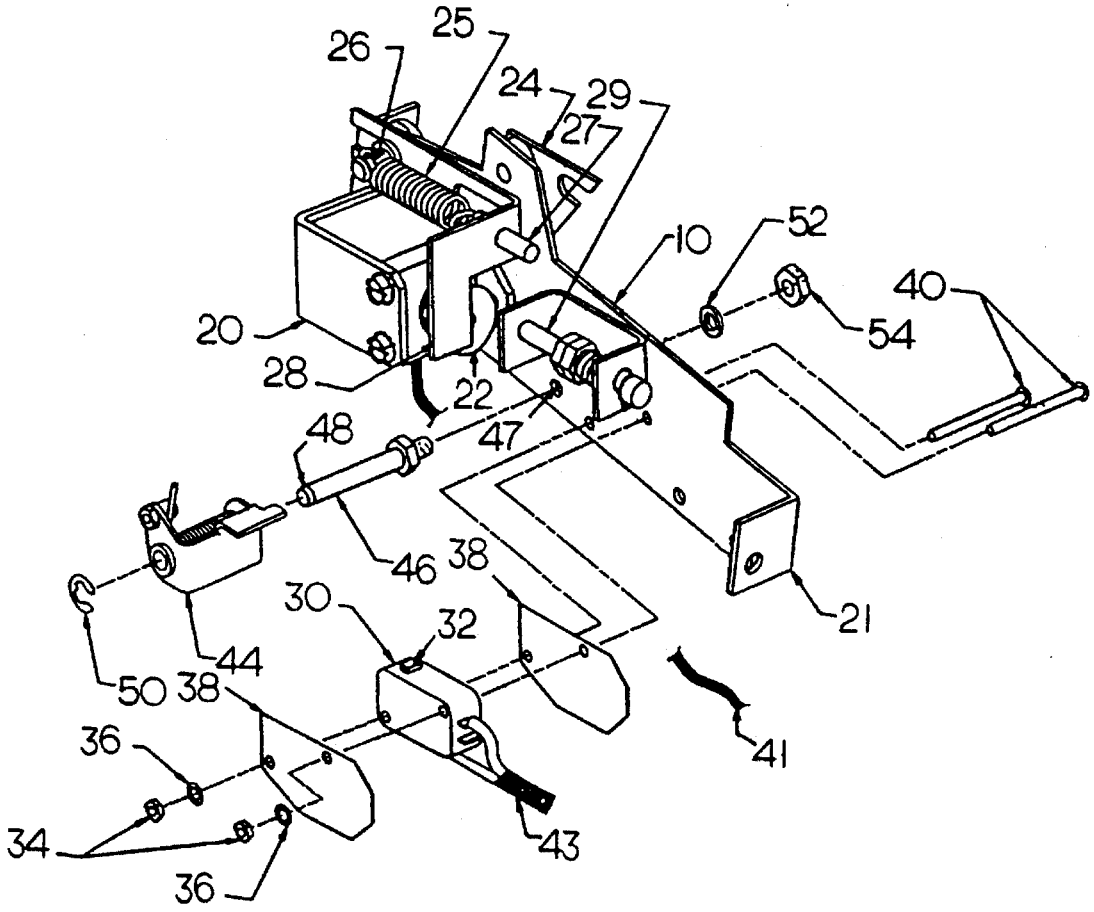
FIG. 1 is an isometric view of an electronic trip unit with disassembled switch actuator and switch for the first embodiment of the invention.
Figure 2:
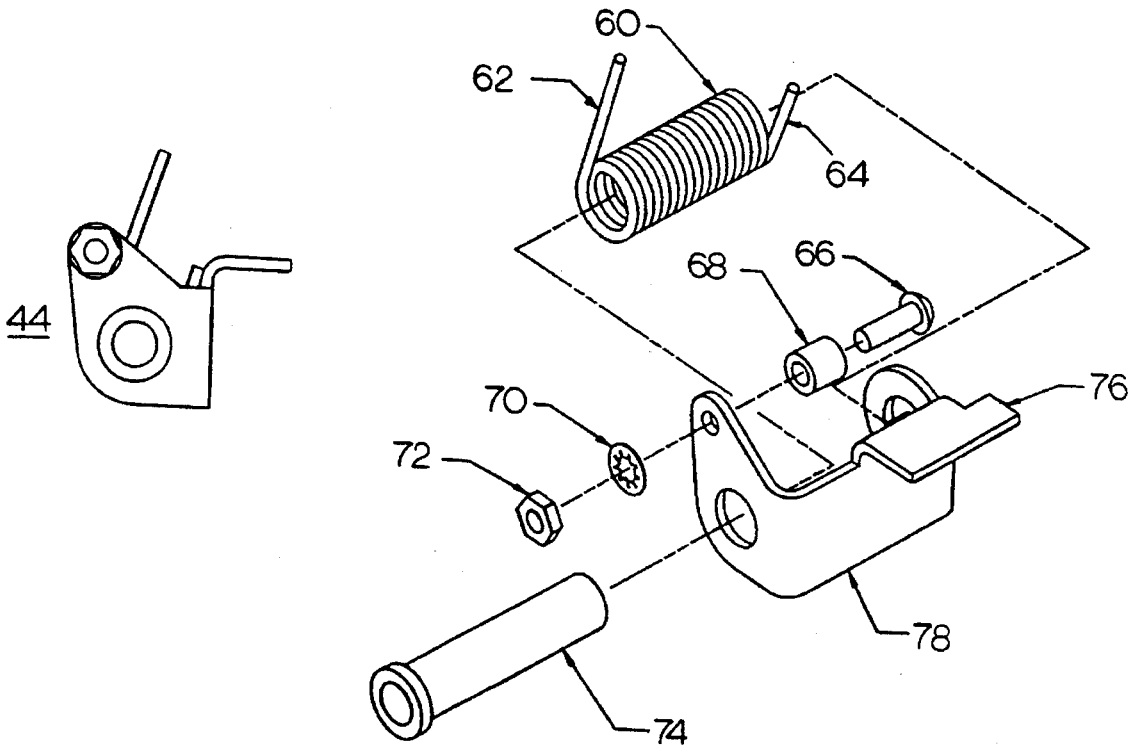
FIG. 2 is a side view and a disassembled view of a switch actuator for the first embodiment of the invention.

To facilitate signal transmission from the electronic trip unit 10, shown in FIG. 1, to the programmer box indicating that the electronic trip unit 10 has been actuated, the circuit breaker trip unit 10 has been fitted with a switch actuator 44 and a switch 30 as shown in FIG. 2.

When the flux shifter 20 of the circuit breaker's electronic trip unit 10 changes the circuit breaker's contacts from their closed to their open position, a switch 30 is also activated by a switch actuator 44. As a result, a signal can be transmitted from the switch 30 to the programmer box by switch wiring 43.

When the flux shifter 20 of the electronic trip unit 10 receives a signal on wires 41 to trip the circuit breaker contacts, the flux shifter 20 displaces the flux shifter plunger 22 away from the flux shifter 20. The flux shifter plunger 22 then contacts and displaces the trip plunger 29 away from the flux shifter 20. The displaced trip plunger 29 causes the circuit breaker contacts to trip from their closed to their open position in a manner similar to that described in U.S. Pat. No. 4,001,742.

References are now made to both FIGS. 1 and 2. The displaced reset slide 28 contacts the first leg 62 of the take-up spring 60 of the switch actuator 44. The first leg 62 is displaced by the reset slide 28 away from the flux shifter 20 causing the take-up spring 60 to rotate clockwise about the tube 74 inserted through the switch actuator frame 78. As the take-up spring 60 rotates, the second leg 64 of the take-up spring 60 contacts the switch actuator frame 78 so as to rotate the switch actuator frame 78 clockwise about the switch actuator pivot pin 46. As a result, the tab 76 on the switch actuator frame 78 contacts and depresses the switch button 32 on the switch 30. When the switch button 32 is depressed, an electrical signal is transmitted from the switch 30 along the wires 43 to the programmer box. After the circuit breaker contacts have been tripped from their closed to their open position, a mechanical feedback mechanism rotates the reset crank 24 clockwise so as to return the reset slide 28 and the flux shifter plunger 22 to their untripped positions. The reset crank 24 is connected to the reset slide 28 by a coupling linkage that includes a coupling spring 25.

Circuit breakers have ranges of operating tolerances. Therefore the take-up spring 60 is utilized to absorb over travel from the mechanical feedback mechanism so that neither the switch actuator 44 nor the switch 30 are damaged.

The switch actuator 44 is attached to the frame 21 of the electronic trip unit 10 by a pivot pin 46 inserted through an aperture 47 in the frame 21. The pivot pin 46 is affixed to the frame 21 with switch actuator mounting hardware 52, 54. The switch actuator 44 is fastened to the pivot pin 46 by a retaining ring 50 inserted over a groove 48 in the pivot pin 46. The switch 30 is mounted to the frame 21 with switch mounting hardware 34, 36, 38, 40.

Figure 3:
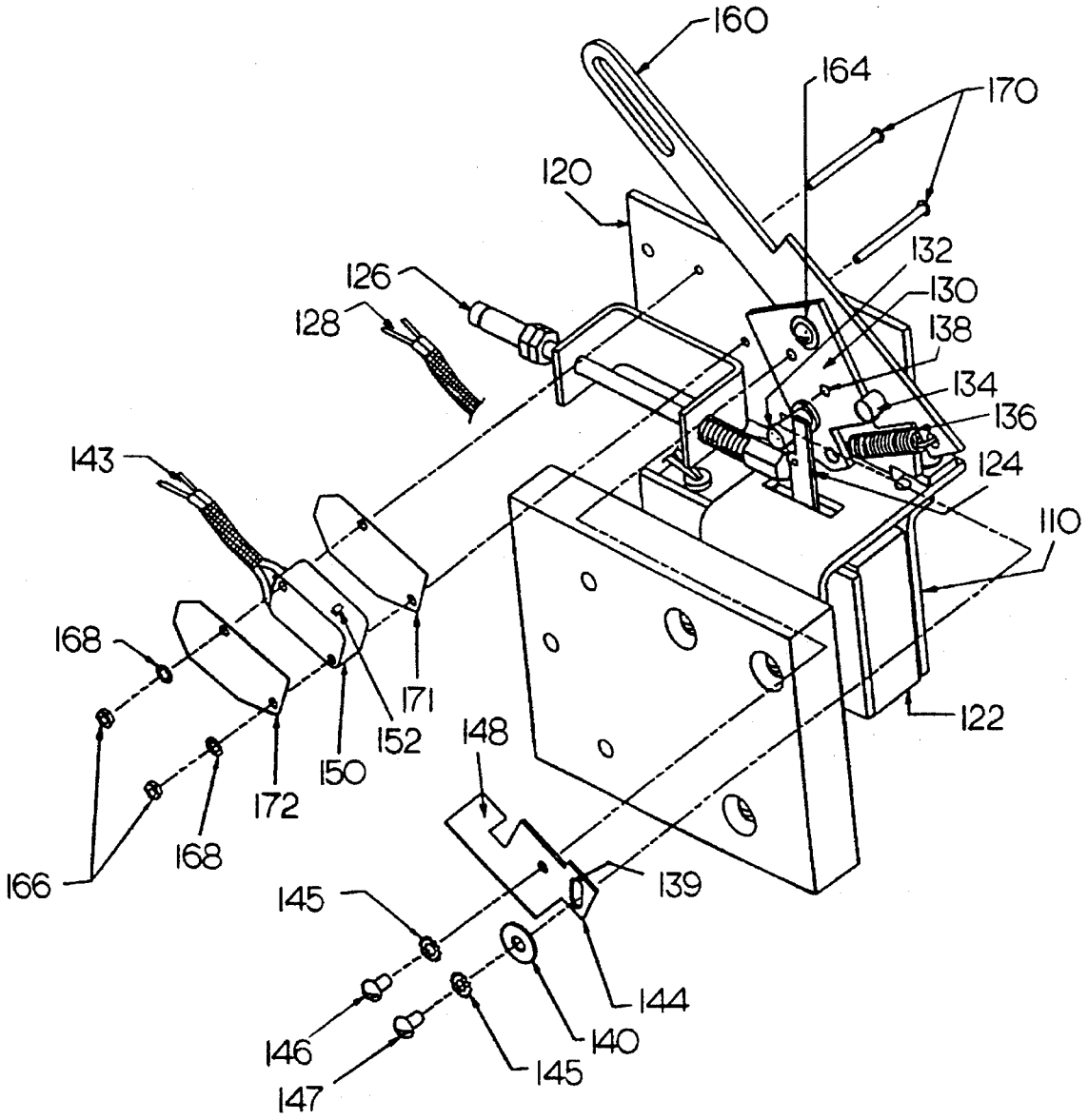
FIG. 3 is an isometric view of an electronic trip unit with disassembled switch actuator and switch for the second embodiment of the invention.

A second embodiment is described that facilitates the signal transmission from the electronic trip unit 110, as shown in FIG. 3, to the programmer box indicating that the electronic trip unit has been actuated.

To accomplish the signal transmission, the circuit breaker electronic trip unit 110 has been fitted with a switch actuator 144 and a switch 150. When the circuit breaker's contacts are tripped from their closed to their open position, a reset linkage 130, 144, 160 that includes the switch actuator 144 causes the switch 150 to send an electrical signal to the programmer box.

Normally, the circuit breaker contacts are in their closed position. As a result, a coupling mechanism from the circuit breaker contacts displaces the reset linkage 130, 144, 160 clockwise about the first pivot 164. Specifically, the coupling mechanism rotates the first reset lever 160 clockwise about the first pivot 164. Eventually the reset lever stop post 134 on the first reset lever 160 contacts and rotates the flux shifter reset lever 130 clockwise about the first pivot 164. Thus the reset pin 132 on the flux shifter reset lever 130 is displaced away from the trip arm 124 of the flux shifter 122.

When the flux shifter 122 of the electronic trip unit 110 receives an electrical signal on its wires 128 to trip the circuit breaker contacts, the flux shifter 122 displaces the trip arm 124 towards the plunger 126. The trip arm 124 eventually contacts and displaces the plunger 126 away from the trip arm 124 so as to cause the circuit breaker contacts to trip from their closed to their open position in a manner similar to that described in U.S. Pat. No. 4,001,742.

When the circuit breaker contacts have been tripped from their closed to their open position, a mechanical feedback mechanism rotates the reset linkage 130, 144, 160 counterclockwise about the first pivot 164. As a result, the switch actuator 144 is also rotated counterclockwise about the first pivot 164 so that the tab 148 on the switch actuator 144 contacts and depresses the button 152 on the switch 150. When the button 152 is depressed, an electrical signal is transmitted from the switch 150 along its wires 143 to the programmer box.

The switch actuator 144 is attached to the flux shifter reset lever 130 by a switch actuator pivot 146, a switch actuator screw 147, and mounting hardware 140, 145. The switch actuator screw 147 is inserted through a slot aperture 139 in the switch actuator and a first aperture 138 in the flux shifter reset lever 130 to permit adjusting the position of the switch actuator 144 about the switch actuator pivot 146 so that the switch actuator 144 contacts and depresses the button 152 when the circuit breaker contacts are tripped from their closed to their open positions. The switch 150 is fastened to the electronic trip unit frame 120 by mounting hardware 166, 168, 170, 172.

Simultaneously when the circuit breaker contacts have been tripped from their closed to their open position, the mechanical feedback mechanism also causes the reset pin 132 on the flux shifter reset lever 130 to contact and displace the trip arm 124 away from the plunger 126 to its original untripped position. Because circuit breakers have ranges of operating tolerances, a reset take-up spring 136 is attached between the first reset lever 160 and the flux shifter reset lever 130 to permit reset linkage 130, 144, 160 over travel. Thus if movement of the reset linkage 130, 144, 160 by the mechanical feedback mechanism, when the circuit breaker contacts have been tripped from their closed to their open position, is blocked by either the flux shifter trip arm 124 or the switch 150, the reset take-up spring 136 allows the continued displacement of the mechanical feedback mechanism and the first reset lever 160.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention what we claim as new and desire to secure by Letters Patent is:

1. An apparatus on a circuit breaker having an electronic trip unit for signaling a remote programmer box that the circuit breaker contacts have been tripped from their closed to their open position comprising:

tripping means responsive to said electronic trip unit for displacing circuit breaker contacts from closed to open positions;

switch means on said tripping means for signaling a programmer box when circuit breaker contacts have been tripped from closed to open positions; switch actuator means on said tripping means for engaging said switch means when said tripping means displaces both the switch actuator means and the circuit breaker contacts from their closed to their open positions;

a mechanical feedback mechanism to both reset said tripping means and disengaged said switch actuator means from said switch means when the circuit breaker contacts are displaced from their closed to their open position, and first take-up spring means for absorbing over-travel from the mechanical feedback mechanism.

2. The apparatus of claim 1 wherein said switch actuator means further comprises:

actuator frame means;

bushing means inserted through said actuator frame means and said switch actuator take-up spring means;

tab means on said actuator frame means for contacting said switch means when said tab means is displaced in a first direction;

pin means attached to said actuator frame means;

first leg means on said switch actuator take-up spring means that contacts said actuator frame means; and second leg means on said first take-up spring means for displacing said tab means against said switch means to signal a programmer box that circuit breaker contacts have been displaced from their open to their closed position.

3. The apparatus of claim 2 wherein said switch means further comprises:

button means for causing said switch means to signal a programmer box that the circuit breaker contacts have been displaced from their closed to their open position when said button means is released by said tab means.

* * * * *